United States Patent [19]

Hartbauer et al.

[11] 4,189,077

[45] Feb. 19, 1980

[54] SHEET MATERIAL DISPENSING DEVICE

[75] Inventors: Ellsworth A. Hartbauer, Concord; Rudolf R. Weis, Antioch, both of Calif.

[73] Assignee: Crown Zellerbach Corporation, San Francisco, Calif.

[21] Appl. No.: 940,407

[22] Filed: Sep. 7, 1978

[51] Int. Cl.[2] ..... B26F 3/02

[52] U.S. Cl. ..... 225/14; 225/90

[58] Field of Search ..... 225/14, 15, 12, 11, 225/90

[56] References Cited

U.S. PATENT DOCUMENTS

| | | | |
|---|---|---|---|
| 2,617,198 | 11/1952 | Sharpe | 225/14 X |
| 3,730,409 | 5/1973 | Ratti | 225/14 X |

FOREIGN PATENT DOCUMENTS

| | | | |
|---|---|---|---|
| 2639810 | 9/1978 | Fed. Rep. of Germany | 225/14 |

*Primary Examiner*—Frank T. Yost

*Attorney, Agent, or Firm*—Thomas R. Lampe

[57] ABSTRACT

In a cabinet for manually dispensing sheet material from a roll rotatably mounted within the housing of the cabinet, a combination of a blade having a cutting edge and movable from a first position to a second position relative to the housing when the sheet material is manually pulled against the cutting edge to sever a portion of the sheet material from the remainder of the roll, and sheet delivery means in operative association with the remainder of the sheet material and responsive to movement of the blade from the first position to the second position to deliver the free end of the remainder of the sheet material to a position facilitating manual grasping thereof by the user.

5 Claims, 10 Drawing Figures

106
20a
22a
30a
12a
76a
62a
60a
68a
114
108
102
46a
66a
112
104

12a
30a
62a
104
60a 22a
120a
112
114
120
40a
10
102
42a 30a
106
12a
108
46a
62a
66a
68a
20a
22a
110
8
116
114
76a
60a
104
8
10
40a
120
112
42a
102

SHEET MATERIAL DISPENSING DEVICE

FIELD OF THE INVENTION

This invention relates to a device for dispensing sheet material such as paper toweling or the like, and in particular, to a dispensing device which utilizes a movable cutting blade to not only sever the material being dispensed but also to trigger a drive mechanism to deliver the free end of the remaining portion of the sheet material to a position external of the cabinet housing where it may be grasped by the user.

SUMMARY AND OBJECTS OF THE INVENTION

Roll paper towel dispensers are generally characterized by their complexity, often employing complex mechanical arrangements to meter the desired amount of towel to the user and to subsequently present the newly formed end of the towel to a manually graspable position after the initial length of toweling has been removed by the user.

Prior art towel dispensers also often employ manually actuated cranks or other devices to effect delivery of the towel. Arrangements of this latter type are undesirable since the crank handle or other manually actuatable member may be a breeding ground for bacteria, due to the fact that every user must contact it. While some roll towel dispensers are actuated by the user pulling upon the towel, the relatively complex mechanisms employed in such dispensers ofter exert a considerable force that must be overcome by the user with the result that the portions of the towel wetted by the user's hands may break away leaving the main portion of the desired towel still attached to the cabinet.

It is therefore an object of the present invention to provide a roll towel dispenser of simple and economic construction which is actuated solely by the user pulling upon the towel.

It is a further object of the present invention to provide an improved roll towel dispenser device incorporating a feeding mechanism readily actuated by the user with a minimal amount of force being exerted upon the towel.

These and other objects have been attained in accordance with the present invention by providing in a cabinet for manually dispensing sheet material from a roll rotatably mounted within the housing of the cabinet the combination of a blade having a cutting edge and movable relative to the housing when the sheet material is manually pulled against the edge to sever a portion of the sheet material from the remainder of the roll and sheet delivery means in operative association with the remainder of the sheet material and responsive to movement of the blade to deliver the free end of the remainder of the sheet material to a position facilitating manual grasping thereof by the user. The sheet delivery means includes a roller having an outer surface in frictional engagement with the remainder of the sheet material and drive means including a spring biased rotatable element operatively connected to the roller. The blade has a stop element attached thereto adapted to engage the rotatable element and prevent movement thereof before the blade is moved when performing its cutting function. When the blade is moved to its cutting position the stop element disengages from the rotatable element to permit rotation of the rotatable element and the roller under the bias of the spring.

DETAILED DESCRIPTION

Figure 1:
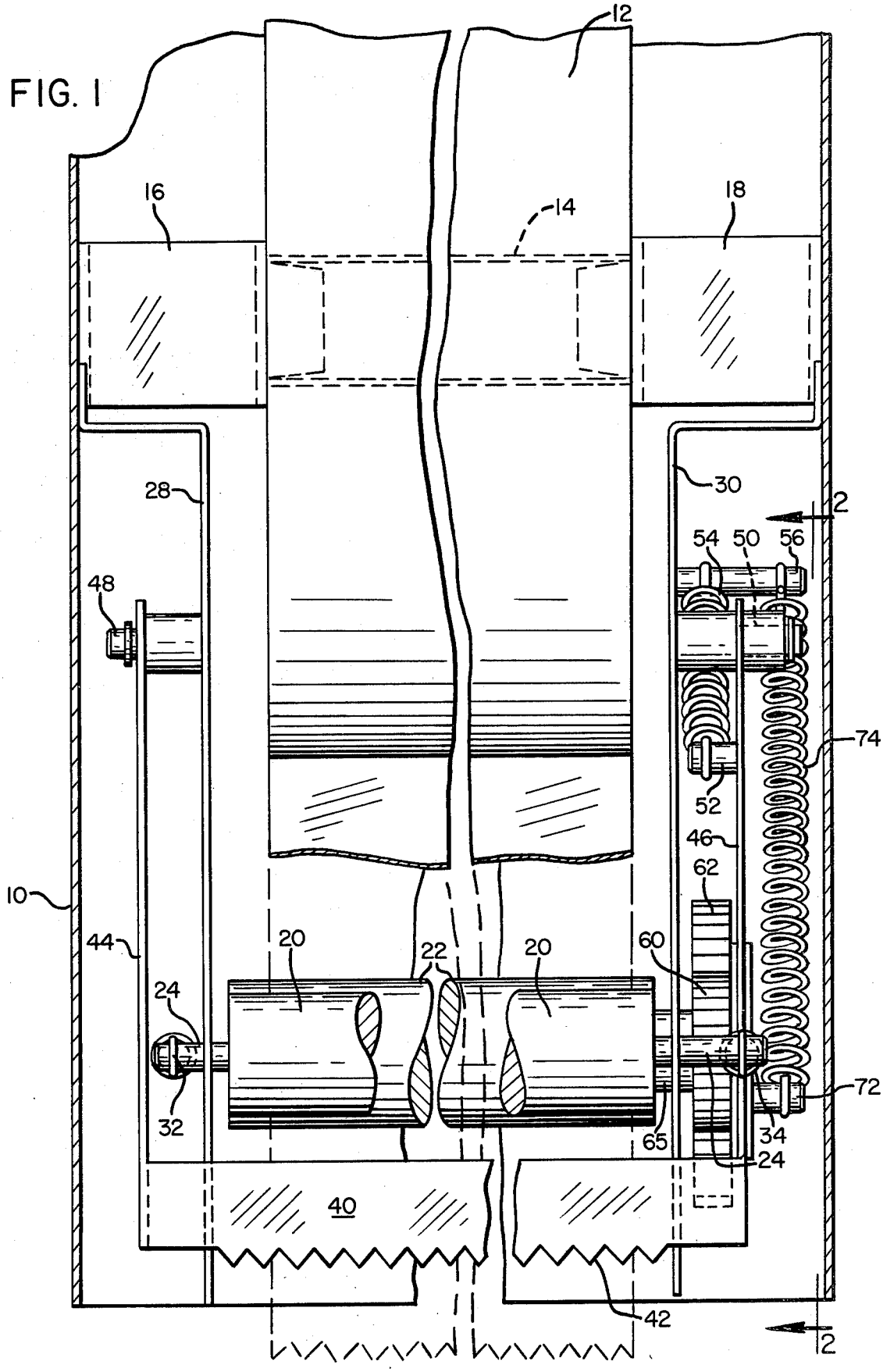
FIG. 1 is a vertical sectional view illustrating the operational components of a cabinet constructed in accordance with the teachings of the present invention.

Referring now to FIGS. 1–5, a portion of a dispensing cabinet incorporating the teachings of the present invention is illustrated. As is the case with conventional arrangements, the cabinet includes a housing 10 within which is disposed a paper towel roll 12. Roll 12, as is also conventional, includes a support core 14 having positioned in the ends thereof portions of support elements 16 and 18 projecting inwardly from the walls of the housing so that the towel roll 12 is rotatable thereabout. The free end of the towel depending from roll 12 projects downwardly from the bottom of the housing so that it may be manually grasped by the user in a conventional manner.

The towel pases through rollers 20 and 22 having axles 24 and 26, respectively, projecting from the ends thereof. Axles 24 and 26 pass through apertures formed in support plates 28 and 30 attached to housing 10 so that the axles and rollers are rotatably mounted with respect thereto and with respect to one another. As may best be seen with reference to FIG. 2, the apertures through which axles 24 of roller 20 project are elongated so that roller 20 is capable of defined linear movement relative to roller 22. Springs 32 and 34 continually urge roller 20 toward roller 22 so that they define a nip through which passes the towel. Due to the frictional forces exerted between the rollers 20 and 22 and the towel, downward movement of the towel will cause the rollers 20 and 22 to move in the direction of the arrows shown in FIG. 2.

Also positioned within housing 10 is a blade 40 having a cutting edge 42 in the form of sharp serrated teeth. The blade 40 extends between and is rigidly connected to the lower legs of L-shaped support members 44 and 46 which are rotatably mounted at the upper ends thereof upon support pegs 48 and 50 which project outwardly from support plates 28 and 30, respectively. A boss 52 projects outwardly from L-shaped support member 46 near the upper end thereof. A spring 54 under tension extends from boss 52 to a second boss 56 fixedly attached to support plate 30. Since spring 54 is under constant tension, the L-shaped support member 46 is continually urged in a clockwise direction as viewed in FIG. 2 so that it normally assues the position shown in that figure, which will hereinafter be referred to as the first position.

Attached to one end of roller 22 and rotatable therewith is a drive gear 60 which meshes with a second gear 62. A pin 64 projects from the center of second gear 62 and is rotatably mounted in any suitable fashion within housing 10 as for example by being journaled in a bearing 65 positioned on support plate 30. Integrally formed with second gear 62 is a cam element 66 having a generally circular outer cam surface 68 and a protrusion 70 projecting outwardly therefrom. A pin 72 is connected to the outermost side of cam element 66 and a spring 74 extends from pin 72 to boss 56. When the operative components of the present invention are in the relative positions illustrated in FIG. 2, spring 74 is under tension and continually urges gear 62 and cam element 66 in a clockwise direction. Movement is, however, prevented by virtue of the fact that L-shaped support member 46 has a detent pin 76 attached thereto, said detent pin being in the path of movement of protrusion 70 when the blade is in its first position illustrated in FIG. 2.

Figure 2:
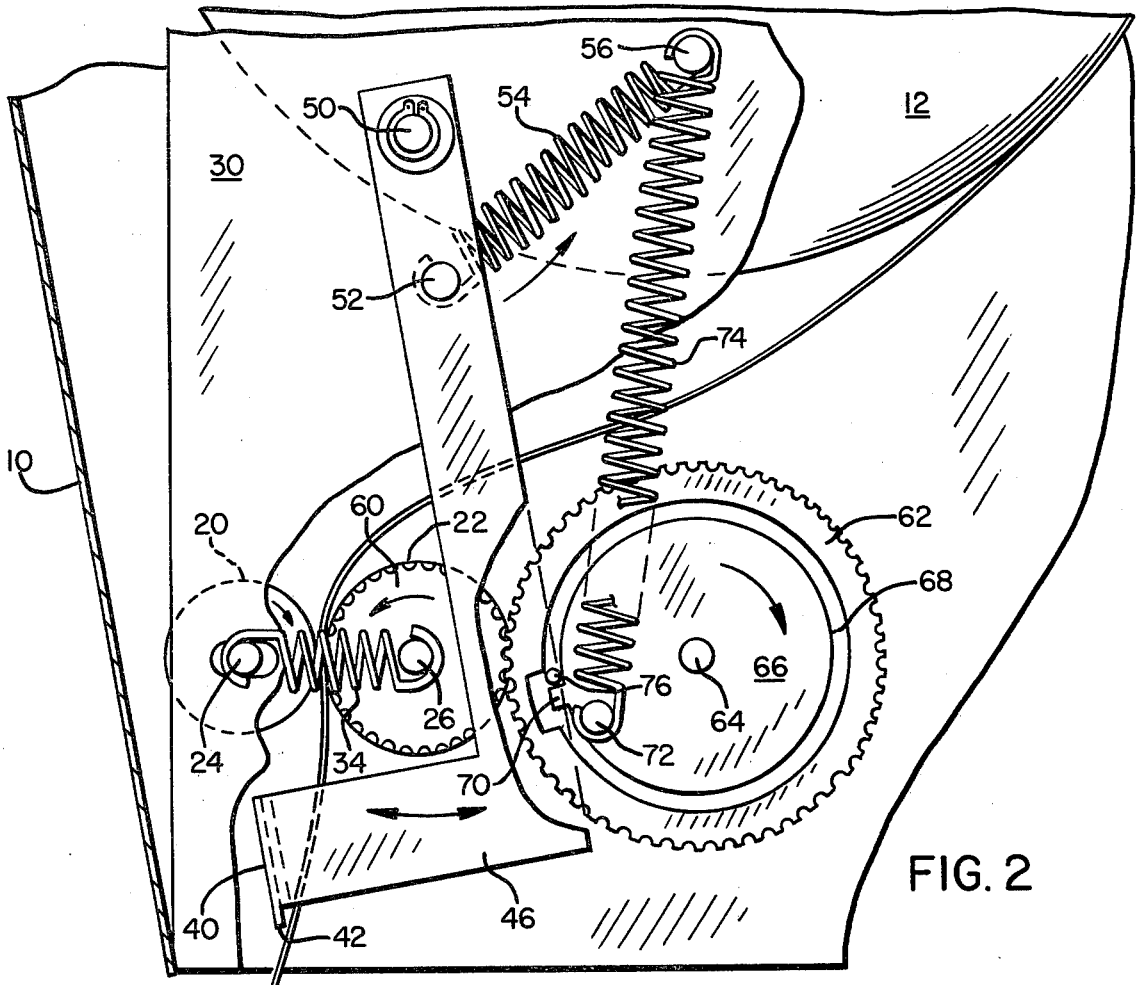
FIG. 2 is a side view taken along the line 2—2 of FIG. 1 and showing the blade of the present invention in its first position.
Figure 3:
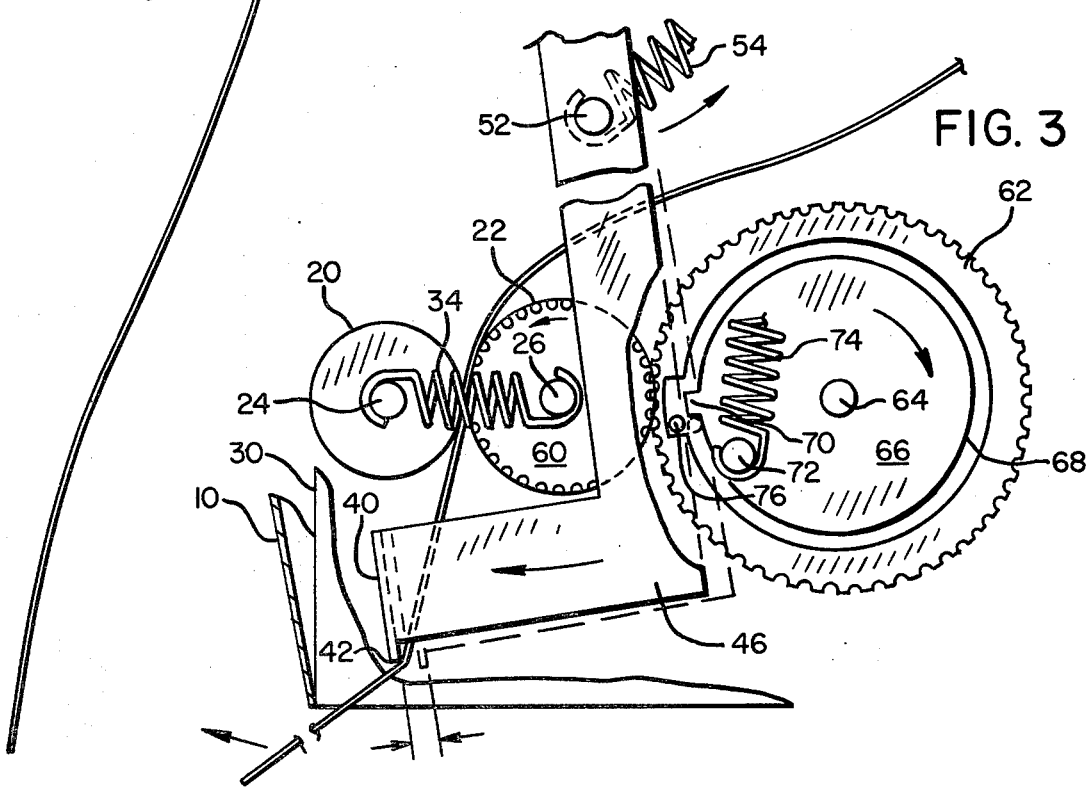
FIG. 3 is a view similar to that of FIG. 2 but illustrating the blade in its second position.

The embodiment of the invention illustrated in FIGS. 1–5 operates as follows. FIG. 2 illustrates the relative positions assumed by the components of the cabinet dispenser mechanism at the point just prior to the user tearing off a towel. To tear the towel the user pulls the towel upwardly and to the left as shown in FIG. 3. This causes L-shaped support members 44 and 46 to move in a clockwise direction as illustrated by the arrow and the blade 40 to move from its first position to its second or cutting position. The towel is severed from the rest of the roll 12 by being pulled against cutting edge 42. Upon clockwise movement of the support member 46, detent pin 76 is pulled to the left as viewed in FIG. 3 and out of engagement witn protrusion 70, thus allowing the sheet delivery means to operate. Cam element 66 and its integral gear 62 move in a clockwise direction under the urging of spring 74 until the various operative elements of the invention come to rest at the relative positions illustrated in FIGS. 4 and 5. When the gear 62 and cam element 66 come to rest, pin 72 has rotated so that it is positioned substantially vertically above pin 64.

Figure 4:
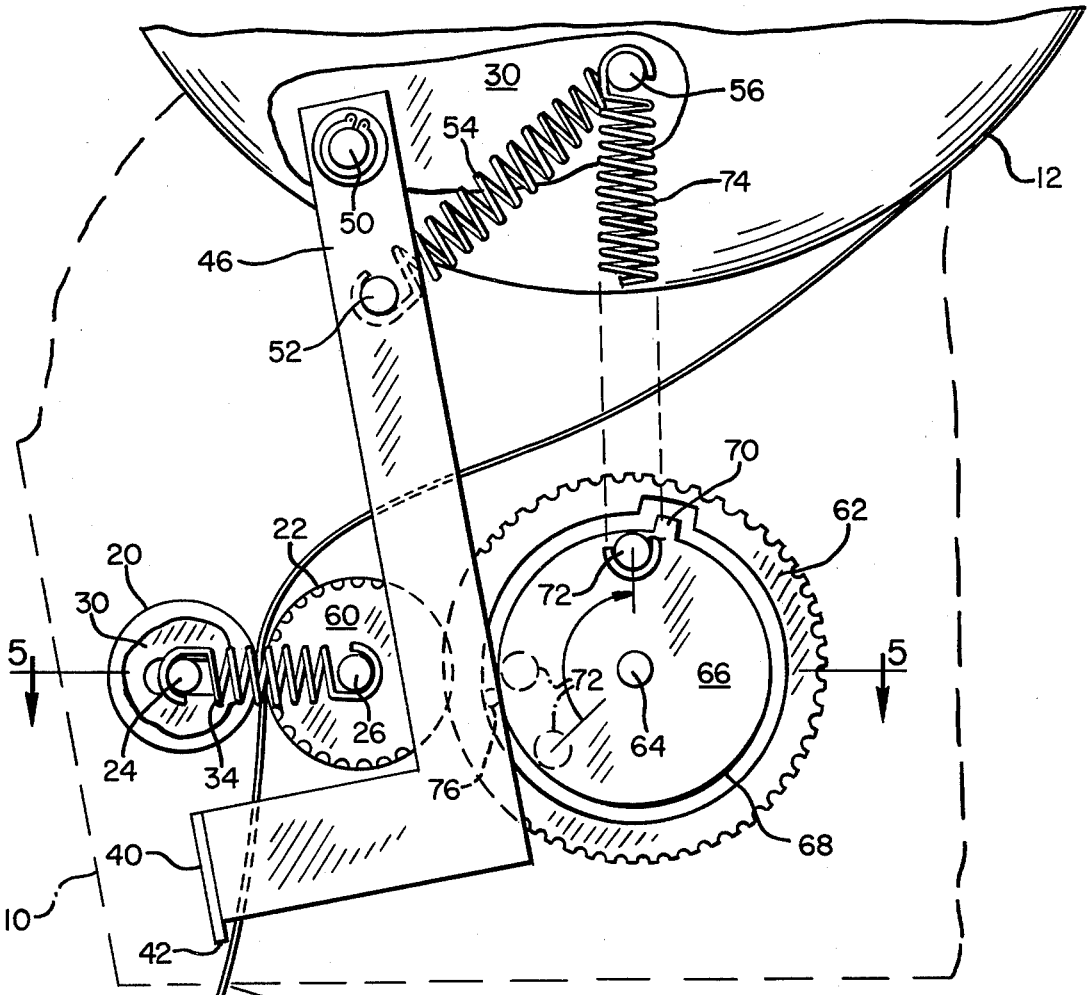
FIG. 4 is view similar to that of FIGS. 2 and 3 but illustrating the operational components of the present invention and the relative positions assumed thereby when the free end of the remainder of the sheet material has been brought to a position facilitating manual grasping thereof by the user to initiate operation of the cabinet.
Figure 5:
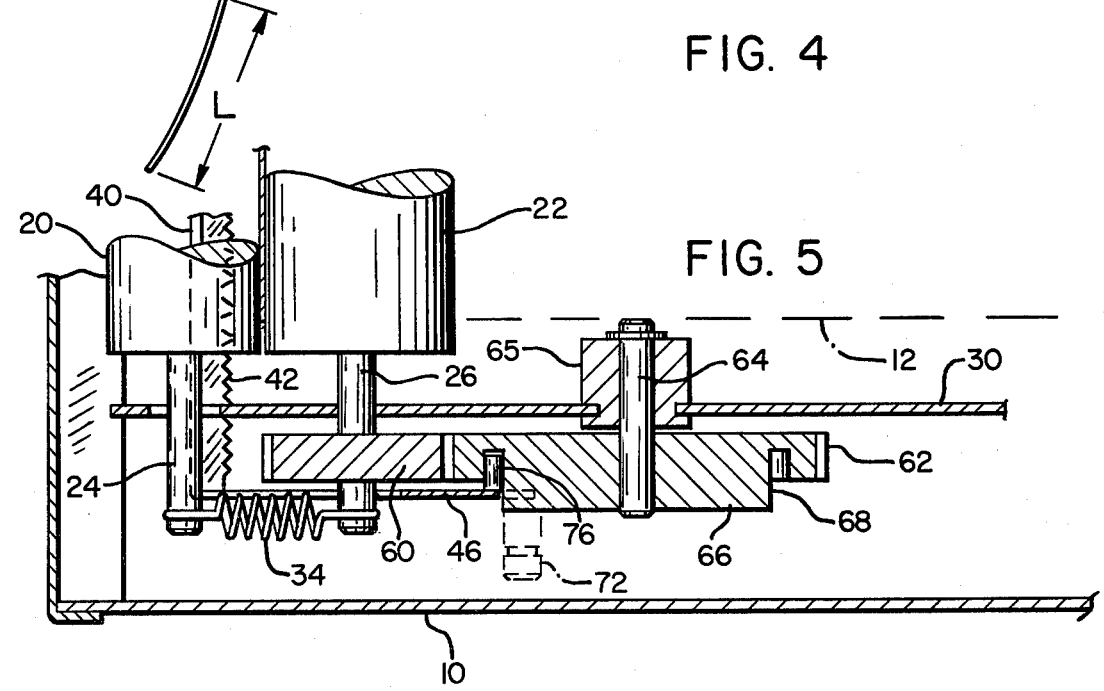
FIG. 5 is a sectional view taken along the line 5—5 of FIG. 4.

Rotational movement of gear 62 from the position illustrated in FIG. 3 to that illustrated in FIG. 4 causes counterclockwise movement of drive gear 60 and its associated roller 22. This serves to deliver a predetermined length L of toweling below the bottom of the dispenser cabinet housing so that it may be grasped by the next user. When the next user wishes to remove another towel he pulls downwardly on the segment L of the towel so that a full towel length projects from the bottom of the housing as shown in FIG. 2. This downward movement of the towel causes counterclockwise movement of roller 22 and associated drive gear 62 and cam element 66 against the urging of spring 74. Rotational movement of cam element 66 continues until protrusion 70 of the cam surface again comes into engagement with detent pin 76, L-shaped support member 46 having been returned to its original position under the urging of spring 54. The operating cycle is then complete and will recommence all over again upon the next user pulling the towel against the cutting edge 42 of blade 40 to sever the towel and pull L-shaped support member 46 in a clockwise direction.

FIGS. 6–10 illustrate another form of apparatus constructed in accordance with the teachings of the present invention. Since the majority of the components of this alternative embodiment correspond exactly to those of the embodiment of FIGS. 1–5, only the features that are different will be described in detail. Components the same as those described with respect to the first embodiment will bear the same reference numbers but with an "a" suffix. New elements will bear new reference numbers.

The embodiment of FIGS. 6–10 incorporates a mechanism which ensures that the user may pull the towel from the cabinet with a uniform force. It will be appreciated that in the arrangement illustrated in FIGS. 1–5 there will be some variance in this regard since the user will have to pull harder as the spring 74 comes under increasing tension upon rotation of cam element 66 until pin 72 is at its lowermost point whereupon the spring 74 will feed an additional length of towel with no pulling pressure being exerted whatsoever by the user. While there is nothing inherently wrong with this, the consumer of roll towels has become accustomed to exerting a uniform force to dispense the towel in prior art cabinet constructions. The arrangement of FIGS. 5–10 will provide the user with the "feel" with which he is familiar when dispensing towels.

Figures 6, 7, 8:
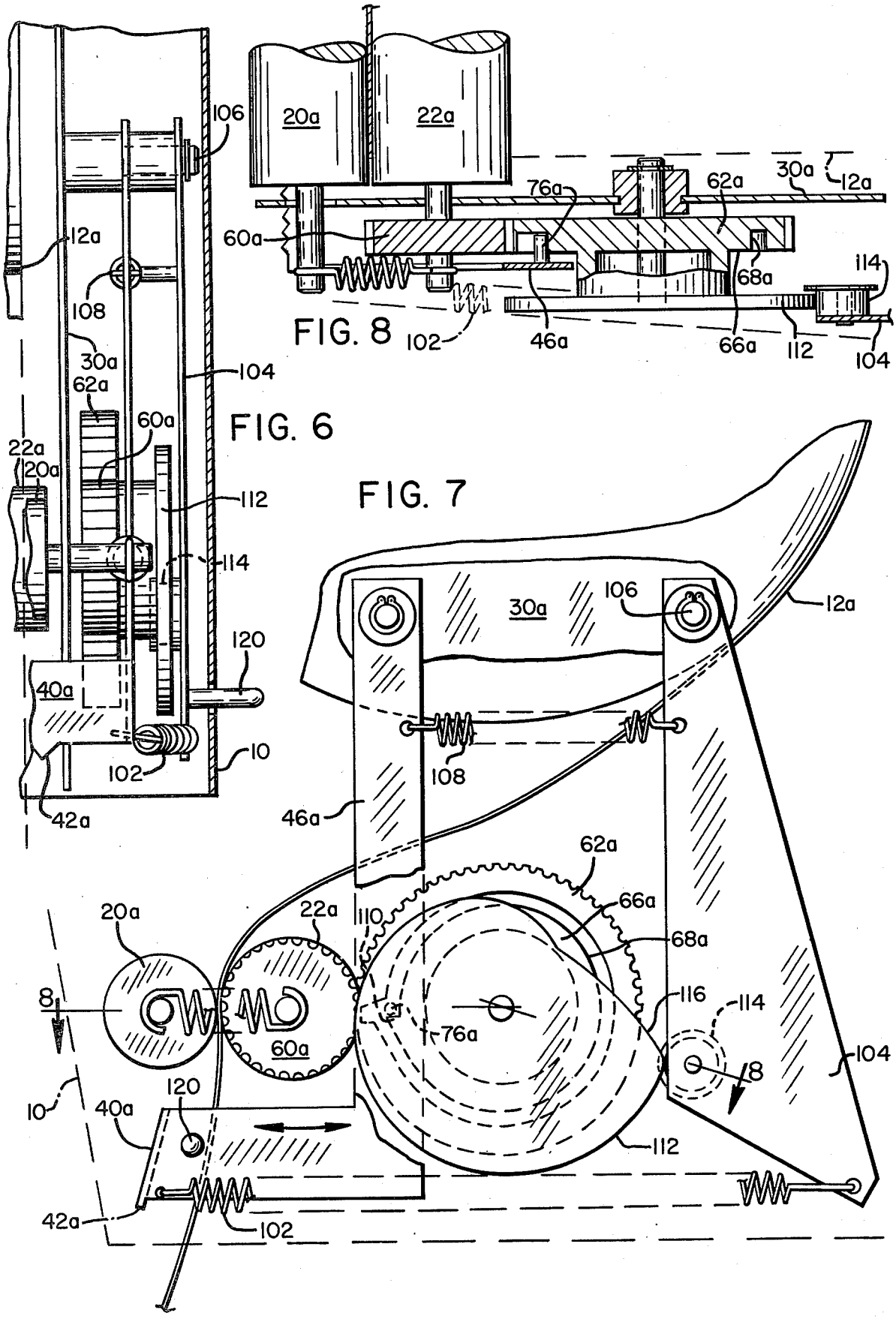
FIG. 6 is a vertical sectional view illustriating a portion of an alternative form of cabinet constructed in accordance with the teachings of the present invention.
FIG. 7 is a partial side view of the operational components of the alternative cabinet and illustrating the blade thereof in its first position.
FIG. 8 is a sectional view taken along the line 8—8 of FIG. 7.

Referring now to FIGS. 6, 7 and 8, L-shaped support member **46*a* has attached to the bottom thereof a coil spring 102, said spring being attached at the other end thereof to a plate 104 rotatable about support pin 106. A second coil spring 108 interconnects member 46*a* and plate 104 at the upper ends thereof. Thus, the two springs 102 and 108 serve to urge L-shaped support member 46*a* in a counterclockwise direction so that blade 40*a* assumes its first position best illustrated in FIG. 7**.

Detent pin **76*a* rides upon a cam surface 68*a* of a cam element 66*a* integrally formed with gear 62*a*. The cam element 66*a* includes a protrusion 110 as may best be seen with reference to FIG. 7. Spaced from gear 62*a* and secured thereto by any desired fashion is a control cam member 112 which rotates with second gear 62*a* and cam element 66*a*. A roller 114 is rotatably secured to plate 104 in any desirable fashion and continuously rides in engagement with the outer cam surface of control cam member 112**.

Figure 9:
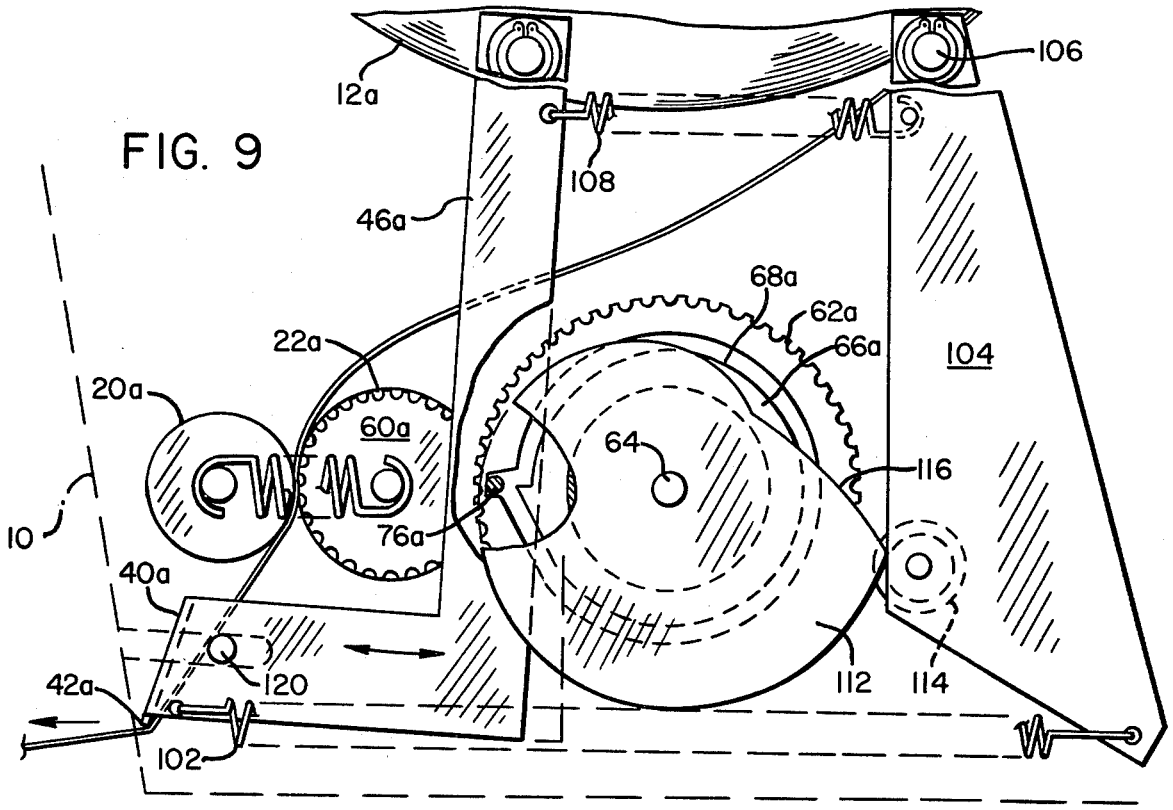
FIG. 9 is a view similar to that of FIG. 7 but illustrating the blade in its second position.
Figure 10:
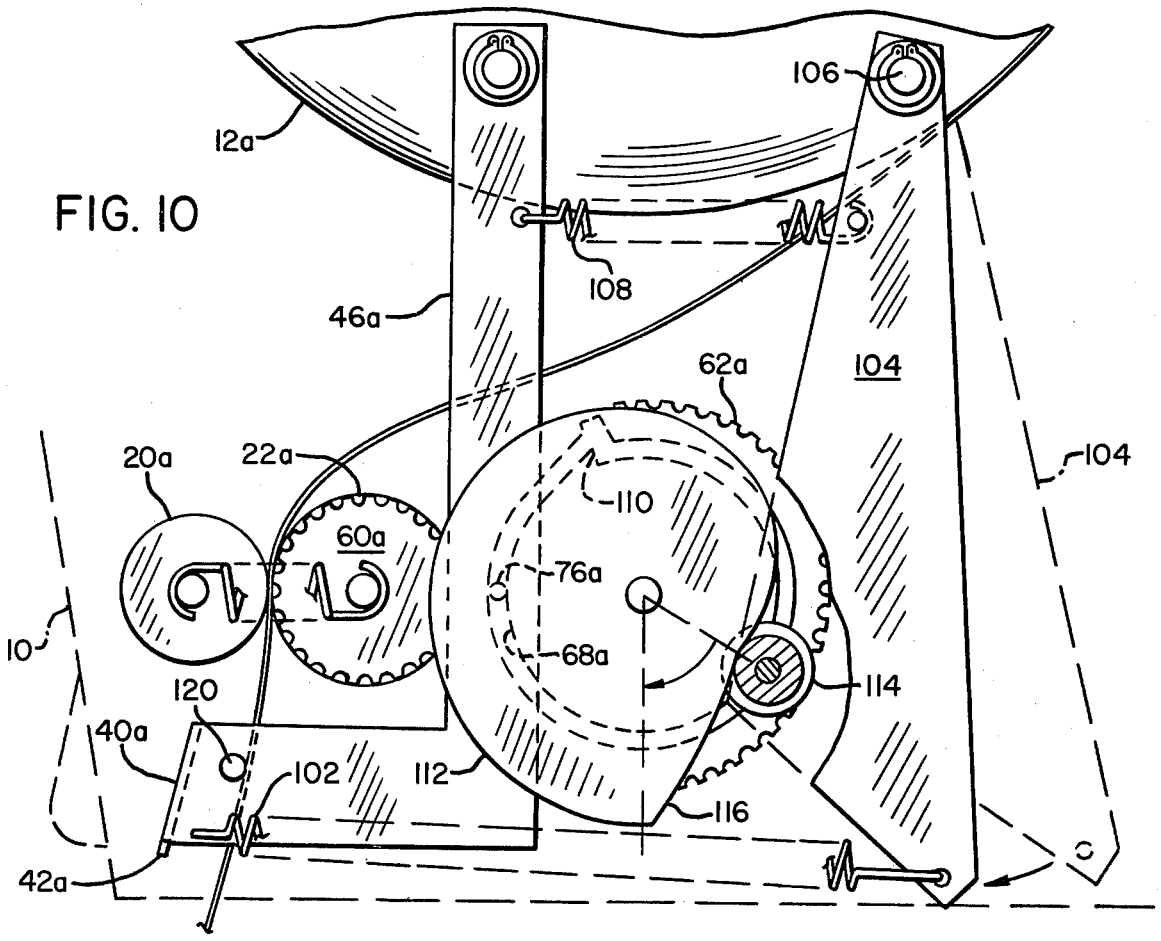
FIG. 10 is a view similar to that of FIGS. 7 and 9 but illustrating the relative positions assumed by the operative components thereof when the towel has been removed by the user and the free end of the remainder of the sheet material has been moved to a position facilitating manual grasping thereof by the user.

The operation of this alternative embodiment of the invention will now be described. The relative positions assumed by the operating components when a complete towel length projects from the bottom of the cabinet and is ready for severing by the user are shown in FIG. 7. When the user wishes to tear off the towel he pulls it upwardly and to the left as shown in FIG. 9. This causes L-shaped support member **46*a* to move in a clockwise direction and the blade 40*a* to move from its first position to its second position. Consequently, the detent pin 76*a* moves out of the path of protrusion 110. The user severs the towel on cutting edge 42*a* and the sheet delivery means of the unit serves to deliver the free end of the remainder of the towel to a position facilitating manual grasping thereof by the user. This is accomplished by virtue of the fact that roller 114 is in engagement with the steep inclined surface 116 of control cam member 112. Springs 102 and 108 urge the roller 114 along the surface 116 and consequently cause rotation of control cam member 112, cam element 66***a* and gear 62*a*. Such movement in turn causes an incremental predetermined length of towel to project from the bottom of the cabinet so that it may be manually grasped by the next user. This condition is illustrated in FIG. 10.

When the next user arrives on the scene he again pulls the towel downwardly until protrusion 110 comes into engagement with detent pin 76*a*, bringing the operative components back to their relative positions illustrated in FIG. 7. Downward pulling of the towel by the user is resisted to a desired degree by virtue of the fact that roller 114 rides along the outer surface of control cam member 112 during rotation thereof. One additional feature incorporated in the embodiment of FIGS. 6–10 is a handle 120 that projects outwardly from L-shaped support member 46*a* through an aperture formed in the housing 10. In the event a towel breaks off in the interior of the cabinet rather than at the cutting edge the user may use the handle to move the L-shaped member 46*a* in a clockwise direction, thus manually causing the sheet delivery means to deliver the free end of the remainder of the sheet material to a position where may be grasped by the user.

We claim:

1. In a cabinet for manually dispensing sheet material from a roll rotatably mounted within the housing of said cabinet, the combination of:

a blade having a cutting edge and movable from a first position to a second position relative to said housing when said sheet material is manually pulled against said cutting edge to sever a portion of said sheet material from the remainder of said roll; and sheet delivery means in operative association with the remainder of said sheet material and responsive to movement of said blade from said first position to said second position to deliver the free end of the remainder of the sheet material to a position facilitating manual grasping thereof by the user.

2. The apparatus according to claim 1 wherein said sheet delivery means includes a roller having an outer surface in frictional engagement with the remainder of the sheet material and drive means for rotating said roller.

3. The apparatus according to claim 2 wherein said drive means includes a spring means biased rotatable element operatively connected to said roller, said blade having a stop element attached thereto adapted to engage said rotatable element and prevent movement thereof when said blade is in said first position and disengage from said rotatable element when in said second position to permit rotation of said rotatable element and said roller under the bias of said spring means.

4. The apparatus according to claim 3 wherein said rotatable element includes a cam and wherein said stop element is a detent pin engaging said cam, said cam including a curved cam surface over substantially the full extent thereof interrupted by projection engageable by said follower pin when said blade is in said first position.

5. The apparatus according to claim 4 wherein said blade is attached to a support member rotatably mounted relative to said housing, said follower pin being affixed to said support member, and a spring connected to said support member to continually urge said blade toward said first position.

* * * * *